United States Patent [19]

Hoselitz

[11] Patent Number: 4,473,400

[45] Date of Patent: Sep. 25, 1984

[54] MAGNETIC METALLIC GLASS ALLOY

[75] Inventor: Kurt Hoselitz, Croydon, England

[73] Assignee: National Research Development Corporation, London, England

[21] Appl. No.: 438,899

[22] PCT Filed: Mar. 24, 1982

[86] PCT No.: PCT/GB82/00095

§ 371 Date: Oct. 28, 1982

§ 102(e) Date: Oct. 28, 1982

[87] PCT Pub. No.: WO82/03411

PCT Pub. Date: Oct. 14, 1982

[30] Foreign Application Priority Data

Mar. 25, 1981 [GB] United Kingdom ..... 8109362

[51] Int. Cl.[3] ..... C22C 38/00

[52] U.S. Cl. ..... 75/123 B; 75/125; 75/123 F; 75/123 L; 75/123 K; 75/124

[58] Field of Search ..... 75/123 B, 125, 123 R, 75/123 F, 123 L, 123 K, 124 R, 124 B, 124 F; 148/31.55, 403

[56] References Cited

U.S. PATENT DOCUMENTS

| | | | |
|---|---|---|---|
| 4,056,411 | 11/1977 | Chen | 75/124 R |
| 4,236,946 | 12/1980 | Aboaf et al. | 75/123 B |
| 4,298,409 | 11/1981 | DeCristofaro et al. | 148/31.55 |

FOREIGN PATENT DOCUMENTS

| | | | |
|---|---|---|---|
| 2806052 | of 0000 | Fed. Rep. of Germany . | |
| 3001889 | of 0000 | Fed. Rep. of Germany . | |
| 3021224 | of 0000 | Fed. Rep. of Germany . | |
| 56-69360 | 6/1981 | Japan | 148/31.55 |

*Primary Examiner*—L. Dewayne Rutledge
*Assistant Examiner*—Debbie Yee
*Attorney, Agent, or Firm*—Oblon, Fisher, Spivak, McClelland, Maier

[57] ABSTRACT

An alloy of composition (by mole) around $Fe_{80}B_{15}Si_5$ with additions of up to 4 mole % Ag or Cu or up to 2% Zn or mixtures thereof when rapidly cooled solidifies to a non-crystalline glass structure, which is ductile and magnetically 'soft', i.e. offering a reasonable saturation magnetization yet with low losses. Exemplary glassy alloy: $Fe_{79.5}B_{15}Si_5Cu_{0.5}$.

24 Claims, No Drawings

MAGNETIC METALLIC GLASS ALLOY

This invention relates to a metallic glass alloy with magnetic properties.

Certain metallic alloys, when cooled sufficiently rapidly, solidify with a glass structure. In this specification, "glass" refers to the amorphous non-crystalline pseudo-liquid atomic structure characteristic of glasses, and carries no implication as to chemical constitution or translucency. A metallic magnet solidified in the form of metallic glass has important advantages, for certain applications, over a normal crystalline magnet. For example, magnetic metallic glasses may find use in transformers as they are magnetically soft and mechanically ductile and flexible (although if over-stressed they may become magnetically harder). After modest shaping, they do not need the costly operation of in situ annealing.

Magnetic metals such as iron, nickel and cobalt would therefore be desirable in glass form, but this requires cooling rates beyond present-day possibility. To render these metals in glass form, they must be alloyed, and additions of 15–25 atomic % of boron, carbon or silicon to transition metals which are solidified by a spin-quenching technique, involving sufficiently rapid cooling, can fairly reliably result in metallic glass alloys.

There are various tests for confirming whether a magnetic alloy specimen is fully glassy, i.e. is perfectly amorphous, and three tests will be briefly considered: X-ray diffraction, ductility and magnetic coercivity.

The X-ray diffraction pattern of a truly amorphous alloy has a broad peak, about 6°–7° wide, corresponding to the mean interatomic spacing. With increasing proportions of crystallinity in a specimen, sharp pips appear on the X-ray pattern (at from about 5% crystallinity), and with greater crystallinity, lines about ½° or 1° wide start to appear.

Ductility provides a most convenient qualitative bench test. If a specimen of thin metallic-glass ribbon can be bent back on itself, and straightened out again, it is amorphous, but if the specimen breaks during this test, it is tending to crystallinity.

The coercivity of a specimen extrapolated to zero Hertz, i.e. the d.c. coercivity, is a most sensitive test for crystallinity. A perfectly amorphous magnetic alloy typically has a d.c. coercivity of 30–70 milliOersted, and certainly not more than 0.1 Oe. With a certain proportion of crystallinity, the d.c. coercivity may be from 0.1 Oe up to 1 Oe, and such specimens may still be usable. Above 1 Oe, the crystallinity is in general too high.

Fe-B-Si glass alloys are known to have good magnetic permeability; while the boron is essential for reliable production of a glass structure, the silicon is found, especially at certain boron concentrations, to reduce the saturation magnetisation by less than the atomic percentage in which it is present; the silicon also increases the crystllisation temperature—that is, improves the thermal stability of the glass.

When considering metallic alloying constituents for improving saturation magnetisation (which is perhaps the most important single property), first principles (atom size, electron structure) suggest that elements such as vanadium, chromium and manganese should be considered. The results are disappointing, and are tabulated hereafter.

According to the present invention, a magnetic metallic glass alloy has the composition, in mole percent:

0–2 of aluminium; 10–22, minus the aluminium, of boron; 0–8 of carbon; 0–10 of germanium; 0–7 of silicon; 0–2 of nickel; and 75–85, minus the nickel, of iron, characterised by containing any of silver, copper and zinc in an amount given by $Ag+Cu+2Zn \not> 4$; commercial impurities not being excluded.

Preferably the amount of boron is from 12 to 17 percent; the aluminium is preferably absent.

Preferably the amount of carbon is from 0 to 4 percent; carbon is more preferably absent.

Preferably the amount of germanium is from 0 to 4 percent, and indeed germanium is more preferably absent.

Preferably the amount of silicon is from 2 to 6 percent, more preferably 4–5½ percent.

The total of aluminium+boron+carbon+germanium+silicon, which must of course be 100−(iron/nickel+silver/copper/zinc), that is from about 11 to 25 percent, is preferably from 17 to 22 percent.

Preferably, nickel is absent, and the preferred amount of iron is then from 78 to 82 percent.

The silver is preferably absent.

The amount of copper is preferaby from 0.2 (more preferably from 0.3, still more preferably from 0.6) to 1½ percent (more preferably up to 1 percent, even more preferably up to 0.8 percent). Much above 1½ percent the copper tends to precipitate.

The amount of zinc is preferably from 0 to 1 percent. (Zinc may be absent).

The amount $Ag+Cu+2Zn$, which in the preferred case is the amount $Cu+2Zn$, is preferably from 0.2 to 3 percent, more preferably from 0.3 to 1½ percent.

The invention will now be described by way of example.

EXAMPLE 1

A mixture of iron boride ($FeB_2$), iron, silicon and copper powders, all of commercial purity, was made up giving a batch in which the constituents were in the molar porportions $Fe_{79.5}B_{15}Si_5Cu_{0.5}$. The batch was melted and allowed to mix thoroughly over a few minutes. The melt was allowed to cool, giving a brittle alloy, which was crushed (for better mixing) and remelted in a crucible with a ¾ mm diameter base ejection nozzle to 50° or 100 C. degrees above the melting point.

The nozzle was opened and the remelt blown out of the crucible (using argon under 0.2 bar) through the nozzle onto the flat rim of a cold copper wheel of 15 cm diameter spinning at 3000–6000 e.g. 4000 revolutions per minute. There resulted a ribbon of 25 to 40 μm thickness, about 1½ to 3 mm wide, of $Fe_{79.5}B_{15}Si_5Cu_{0.5}$ glass. Its magnetic properties could be marginally improved by annealing for 2 hours at 300° C., although this was not in fact done in the Examples.

X-ray diffractometry of the ribbon showed no trace of crystallinity.

The saturation magnetisation per unit mass $\sigma$ was measured for three samples of this material to an accuracy for each sample of about ±¼%. The same was done for three samples of a second batch of alloy, made identically. The reproducibility between samples was ±1%. The average value over all six samples for the saturation magnetisation, measured at 77K and again at 293K, was as follows:

$\sigma_{77}=195$ emu/g $\sigma_{293}=173\frac{1}{2}$ emu/g

To estimate the Curie temperature $\theta_c$, $\sigma$ was assumed to vary with temperature according to the formula, well confirmed experimentally:

$$\sigma_T=\sigma_o(1-\beta(T/\theta_c)^{3/2})$$

where $\beta$ is a constant for any one material; $\beta$ was taken as 0.43, being the value for $Fe_{80}B_{15}Si_5$, and $\sigma_o$ itself was estimated (from $\sigma_{77}$ and $\sigma_{293}$) as 193 emu/g. A notably high value for $\theta_c$ was obtained, consistent with the welcome flatness of the $\sigma$ vs. T curve between 77K and 293K; this value was up to 700K.

The coercivity of the alloy was also measured by the following method. A hysteresis loop of the ribbon was plotted using a pair of identical coils wound on glass tubes (7.5 mm inside diameter, 9 mm outside diameter). The windings were 7 cm long and consisted of 3000 turns for the secondaries, and 486 turns for the primaries, connected in series opposition to compensate for air flux. Single lengths of ribbon were inserted in one of the coils and the output fed to a Tectronic type 536 oscilloscope with type O operational amplifier plug-in unit, set up to integrate and amplify the signal. The primaries were energised from an oscillator and amplifier giving a linear variation of current with drive, with repetition frequencies from 10 to 160 Hz. It is well known in amorphous alloys that although $H_c$ and the area of the loop are small, the anisotropy energy is fairly large. This has been attributed to stresses which result in domains with a strongly preferred axis not in the plane of the ribbon.

Extrapolating to 0 Hz, the coercivity $H_c$ was found to be as low as 55 milliOersted, offering the promise of low losses, without a heavy penalty of reduced saturation magnetisation $\sigma$.

EXAMPLES 2-5

The above procedure was repeated making the following glass alloys according to the invention; $\sigma_{77}$, $\sigma_{293}$, and $\theta_c$ (estimated) are also given in units of emu/g of K, starting with the alloy of Example 1 in the same format. The absolute accuracy of $\theta_c$ may be only $\pm 50$K, but because the errors are probably approximately the same in each estimate of $\theta_c$, the ranking of the alloys in order of their $\theta_c$ is believed to be correct. Coercivity (where measured) was at a maximum field of 5 Oersteds.

| Example | Alloy | $\sigma_{77}$ | $\sigma_{293}$ | $\theta_c$ |
|---|---|---|---|---|
| 1 | $Fe_{79.5}B_{15}Si_5Cu_{0.5}$ | 193.5 | 174.5 | 700 |
| 2 | $Fe_{79.6}B_{14.9}Si_5Zn_{0.5}$ | 194.6 | 176.6 | 740 |
| 3 | $Fe_{79.2}B_{20}Cu_{0.8}$ | 196.9 | 175 | 700 |
| 4 | $Fe_{81.2}B_{13}Si_5Cu_{0.8}$ | 199.6 | 172.5 | 590 |
| 5 | $Fe_{80.6}B_{16.5}Si_{2.5}Cu_{0.4}$ | 196.1 | 176.2 | 695 |
| 6 | $Fe_{79.5}B_{17.5}Si_{2.5}Cu_{0.5}$ | 197.9 | 172.7 | 625 |
| 7 | $Fe_{79.0}B_{17.5}Si_{2.5}Cu_{1.0}$ | 197.6 | 173.7 | 630 |

The following comparative glass alloys, not according to the invention, were made and measured for comparison; the results are to the foregoing standards, except for those marked with an asterisk, which are for technical reasons not as certain:

| Alloy | $\sigma_{77}$ | $\sigma_{293}$ | $\theta_o$ |
|---|---|---|---|
| $Fe_{80}B_{15}Si_5$ | 196.5 | 171.2 | 625 |
| *$Fe_{70}B_{15}Si_5V_1$ | 180.2 | 154.9 | 630 |
| *$Fe_{76}B_{15}Si_5V_4$ | 152.2 | 130.5 | 620 |
| $Fe_{79}B_{15}Si_5Cr_1$ | 193.5 | 167 | 600 |
| $Fe_{76}B_{15}Si_5Cr_4$ | 167.2 | 140.3 | 550 |
| *$Fe_{78}B_{15}Si_5Mn_2$ | 173.2 | 150.4 | 655 |

The coercivity (extrapolated to zero frequency) was measured for the following alloys, and had the values given (milliOersteds):

| | | |
|---|---|---|
| $Fe_{80}B_{15}Si_5$ | (comparative) | 70 |
| $Fe_{79.5}B_{15}Si_5Cu_{0.5}$ | (Example 1) | 55 |
| $Fe_{81}B_{16.5}Si_{2.5}$ | (comparative) | 43 |
| $Fe_{80.6}B_{16.5}Si_{2.5}Cu_{0.4}$ | (Example 5) | 41 |

I claim:

1. A metallic glass alloy consisting essentially of, in mole percent:

a total aluminum and born content of 10-22 with aluminum ranging from 0—2; 0-8 of carbon; 0-10 of germanium; 0-7 of silicon; a total nickel and iron content of 75-85 with the nickel ranging from 0-2;

wherein, in addition to the above-listed elements, said metallic glass alloy further contains at least one element selected from silver, copper and zinc in an amount given by $$Ag+Cu+2Zn=0.2 \text{ to } 4 \text{ mole percent}$$

wherein commercial impurities are not excluded.

2. An alloy according to claim 1, wherein the amount of boron is from 12 to 17 percent.

3. An alloy according to claim 1, wherein aluminium is absent.

4. An alloy according to claim 1, wherein the amount of carbon is from 0 to 4 percent.

5. An alloy according to claim 4, wherein carbon is absent.

6. An alloy according to claim 1, wherein the amount of germanium is from 0 to 4 percent.

7. An alloy according to claim 6, wherein germanium is absent.

8. An alloy according to claim 1, wherein the amount of silicon is from 2 to 6 percent.

9. An alloy according to claim 8, wherein the amount of silicon is from 4 to $5\frac{1}{2}$ percent.

10. An alloy according to claim 1, wherein the total of aluminium, boron, carbon, germanium and silicon is from 17 to 22 percent.

11. An alloy according to claim 1, wherein nickel is absent.

12. An alloy according to claim 11, wherein the amount of iron is from 78 to 82 percent.

13. An alloy according to claim 1, wherein silver is absent.

14. An alloy according to claim 1, wherein the amount of copper is from 0.2 to $1\frac{1}{2}$ percent.

15. An alloy according to claim 14, wherein the amount of copper is at least 0.3 percent.

16. An alloy according to claim 15, wherein the amount of copper is at least 0.6 percent.

17. An alloy according to claim 14, wherein the amount of copper is up to 1 percent.

18. An alloy according to claim 17, wherein the amount of copper is up to 0.8 percent.

19. An alloy according to claim 1, wherein the amount of zinc is from 0 to 1 percent.

20. An alloy according to claim 1, wherein the total of silver plus copper plus twice the zinc is from 0.2 to 3 percent.

21. An alloy according to claim 20, wherein the total of silver plus copper plus twice the zinc is from 0.3 to 1½ percent.

22. An alloy according to claim 1, whose coercivity (extrapolated to zero frequency) is up to 1 Oersted.

23. An alloy according to claim 22, whose coercivity (extrapolated to zero frequency) is not more than 0.1 Oersted.

24. A metallic glass alloy selected from the group of alloys consisting of the following molecular compositions:

$Fe_{79.5}B_{15}Si_5Cu_{0.5}$
$Fe_{79.6}B_{14.9}Si_5Zn_{0.5}$
$Fe_{79.2}B_{20}Cu_{0.8}$
$Fe_{81.2}B_{13}Si_5Cu_{0.8}$
$Fe_{80.6}B_{16}Si_{2.5}Cu_{0.4}$
$Fe_{79.5}B_{17.5}Si_{2.5}Cu_{0.5}$
$Fe_{79.0}B_{17.5}Si_{2.5}Cu_{1.0}$

* * * * *